US012653299B2

(12) United States Patent
Hwang

(10) Patent No.: US 12,653,299 B2
(45) Date of Patent: Jun. 16, 2026

(54) COSMETIC BRUSH

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 260 days.

(21) Appl. No.: 17/862,229

(22) Filed: Jul. 11, 2022

(65) Prior Publication Data

US 2023/0017670 A1 Jan. 19, 2023

(30) Foreign Application Priority Data

Jul. 12, 2021 (KR) ..... 10-2021-0091154

(51) Int. Cl.
*A46B 5/00* (2006.01)
*A46B 9/02* (2006.01)

(52) U.S. Cl.
CPC ..... *A46B 5/0095* (2013.01); *A46B 9/021* (2013.01); *A46B 2200/1046* (2013.01)

(58) Field of Classification Search
CPC ..... A46B 5/0095; A46B 5/02; A46B 7/04; A46B 7/042; A46B 7/046; A46B 9/021; A46B 2200/1046; A46B 3/00; A46B 3/08
See application file for complete search history.

(56) References Cited

U.S. PATENT DOCUMENTS 301,442 A 7/1884 Funk
3,434,176 A 3/1969 Cazet
5,926,903 A * 7/1999 Kim ..... A46B 5/0095 15/176.3
9,808,076 B1 * 11/2017 DeVito ..... A46B 7/023
(Continued)

FOREIGN PATENT DOCUMENTS

CN 102006798 A 4/2011
CN 108497687 A * 9/2018 ..... A46B 5/0095
(Continued)

OTHER PUBLICATIONS

Translation of KR 20210030119 A (Year: 2021).*
(Continued)

*Primary Examiner* — David S Posigian
*Assistant Examiner* — Steven Huang
(74) *Attorney, Agent, or Firm* — Heedong Chae; Lucem, PC

(57) ABSTRACT

Disclosed is a cosmetic brush. The cosmetic brush includes a brush body provided with a user's handle; a brush coupling part coupled to the brush body; a brush bristle part detachably coupled to the brush coupling part and provided with a bristle member; and a connection fixing part having one side coupled to the brush body and the other side supporting the bristle member and provided to surround the brush coupling part, wherein the brush coupling part includes a first coupling portion and a second coupling portion detachably coupled to each other, the brush coupling part is detachably
(Continued)

coupled to the brush body while the first coupling portion and the second coupling portion are coupled to each other, and the brush bristle part is detachably coupled to the brush coupling part.

1 Claim, 4 Drawing Sheets

(56) References Cited

U.S. PATENT DOCUMENTS

| | | | | |
|---|---|---|---|---|
| 2006/0216104 | A1* | 9/2006 | Bouix | A46B 11/0041 401/270 |
| 2007/0199575 | A1* | 8/2007 | Del Ponte | A45D 40/18 132/320 |
| 2009/0139044 | A1 | 6/2009 | Kwan et al. | |
| 2010/0043815 | A1* | 2/2010 | Levy | A46B 7/023 132/200 |
| 2020/0281341 | A1* | 9/2020 | Park | A45D 34/042 |
| 2020/0397131 | A1* | 12/2020 | Maurin | A45D 33/00 |
| 2022/0125188 | A1* | 4/2022 | Hwang | A46B 7/046 |
| 2022/0232961 | A1* | 7/2022 | Hwang | A46B 3/10 |
| 2023/0413983 | A1* | 12/2023 | Lin | A45D 34/042 |
| 2024/0225258 | A1* | 7/2024 | Phillips | A46B 5/0095 |

FOREIGN PATENT DOCUMENTS

| | | | | | |
|---|---|---|---|---|---|
| FR | 3111776 | A1 | * | 12/2021 | A46B 9/10 |
| JP | 2005-028083 | A | | 2/2005 | |
| KR | 10-2007-0106025 | A | | 10/2007 | |
| KR | 20190009443 | A | * | 1/2019 | |
| KR | 10-2020-0025383 | A | | 3/2020 | |
| KR | 10-2020-0107060 | A | | 9/2020 | |
| KR | 20210030119 | A | * | 3/2021 | |
| WO | WO-2021030028 | A1 | * | 2/2021 | A45D 27/04 |

OTHER PUBLICATIONS

Translation of KR 20190009443 A (Year: 2019).*
Translation of CN 108497687 A (Year: 2018).*
Translation of FR 3111776 A1 (Year: 2021).*

* cited by examiner

COSMETIC BRUSH

CROSS-REFERENCE TO RELATED APPLICATIONS

This application claims the priority of Korean Patent Application No. 10-2021-0091154 filed on Jul. 12, 2021, in the Intellectual Property Office, the disclosure of which is incorporated herein by reference.

BACKGROUND OF THE INVENTION

Field of the Invention

The present disclosure relates to a cosmetic brush and more particularly, to a cosmetic brush capable of assembling a complete product without using an adhesive in a process of manufacturing a brush.

Description of the Related Art

In general, cosmetics used for make-up are formed in a liquid, a solid, and a mixed state of the liquid and the solid. Among them, in order to apply the solid cosmetics on the face, brushes having various shapes and sizes have been developed and used.

That is, the above-described brushes are provided so that the cosmetics made of solid powder may be coated on bristles of the brush to be properly applied on the face and the like. The brush consists of a handle capable of being griped by a user and a brush provided at a front end of the handle and consisting of a plurality of bristles.

In the related art, the brush is coupled to the handle by using chemical materials such as an adhesive. In this case, the adhesive may be formed of a chemical material, which may have a harmful effect on the human body, and considering this, in the case of using an adhesive harmless to the human body, there is a problem that the manufacturing cost increases.

In addition, since the adhesive is a material that is vulnerable to heat, there is a problem that when the adhesive is exposed to heat, an adhesive portion is detached so that the durability deteriorates.

The above-described technical configuration is the background art for helping in the understanding of the present disclosure, and does not mean a conventional technology widely known in the art to which the present disclosure pertains.

SUMMARY OF THE INVENTION

Therefore, an object of the present disclosure is to provide a cosmetic brush capable of assembling a complete product without using an adhesive in a process of manufacturing a brush.

According to an aspect of the present invention, there is provided a cosmetic brush including a brush body provided with a user's handle; a brush coupling part coupled to the brush body; a brush bristle part detachably coupled to the brush coupling part and provided with a bristle member; and a connection fixing part having one side coupled to the brush body and the other side supporting the bristle member and provided to surround the brush coupling part, wherein the brush coupling part includes a first coupling portion and a second coupling portion detachably coupled to each other, the brush coupling part is detachably coupled to the brush body while the first coupling portion and the second coupling portion are coupled to each other, and the brush bristle part is detachably coupled to the brush coupling part.

The connection fixing part may include a first fixing body having a lower end supported by the brush body; and a second fixing body provided to extend from the first fixing body and having an upper end supporting the bristle member, wherein the first fixing body may be provided to be inclined from a lower end of the second fixing body in the direction of the brush body.

The first coupling portion may include a first body surrounding one side of the lower portion of the brush bristle part; a first inclined portion provided below the first body to be inclined in the direction of the brush body; and a first coupling body provided below the first inclined portion to be screwed to the brush body.

A first flange coupling groove may be provided on an inner wall of the first body and coupled with one side of the flange member of the brush bristle part.

At least one first coupling groove and at least one first coupling protrusion may be provided in the first body, and at least one second coupling protrusion coupled to the first coupling groove and at least one second coupling groove coupled to the first coupling protrusion may be provided in the second body.

The second coupling portion may include a second body surrounding the other side of the lower portion of the brush bristle part and detachably coupled to the first body; a second inclined portion provided below the second body to be inclined in the direction of the brush body; and a second coupling body provided below the second inclined portion to be screwed to the brush body and detachably coupled to the first coupling body.

A second flange coupling groove may be provided on an inner wall of the second body to be coupled with the other side of the flange member of the brush bristle part.

According to the embodiments of the present disclosure, since the brush coupling part is detachably coupled to the brush part while the first coupling portion and the second coupling portion are coupled to each other, and the brush bristle part may be detachably coupled and assembled to the brush coupling part without an adhesive, it is possible to fundamentally block harmful components of the adhesive.

In addition, since the connection fixing part is coupled to the brush body and the brush coupling part while covering the brush coupling part, it is possible to increase the stability of the coupling.

Furthermore, since the brush bristle part is detachable from the brush coupling part, it is possible to easily replace the brush bristle part.

In addition, since the upper end of the connection fixing part may support the outside of the plurality of bristle members, it is possible to prevent the spread of the plurality of bristle members and the like.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
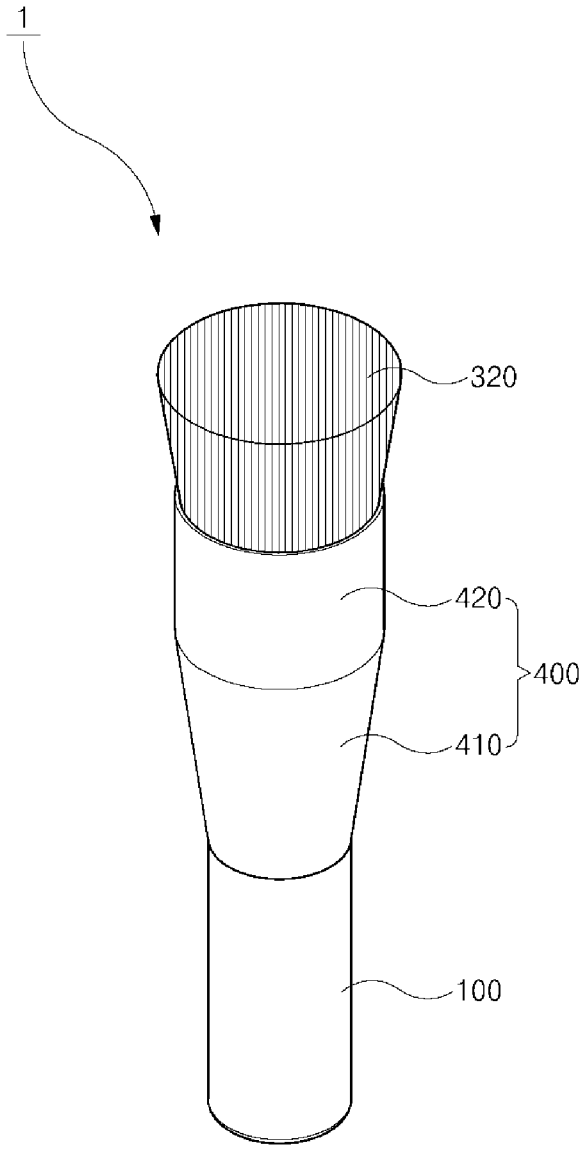
FIG. 1 is a diagram schematically illustrating a cosmetic brush according to an embodiment of the present disclosure.

In order to fully understand the present disclosure, operational advantages of the present disclosure and objects to be achieved by implementing the present disclosure, the present disclosure will be described with reference to the accompanying drawings which illustrate preferred embodiments of the present disclosure and the contents illustrated in the accompanying drawings.

Hereinafter, preferred embodiments of the present disclosure will be described in detail with reference to the accompanying drawings. Like reference numerals illustrated in the respective drawings designate like members.

Figure 2:
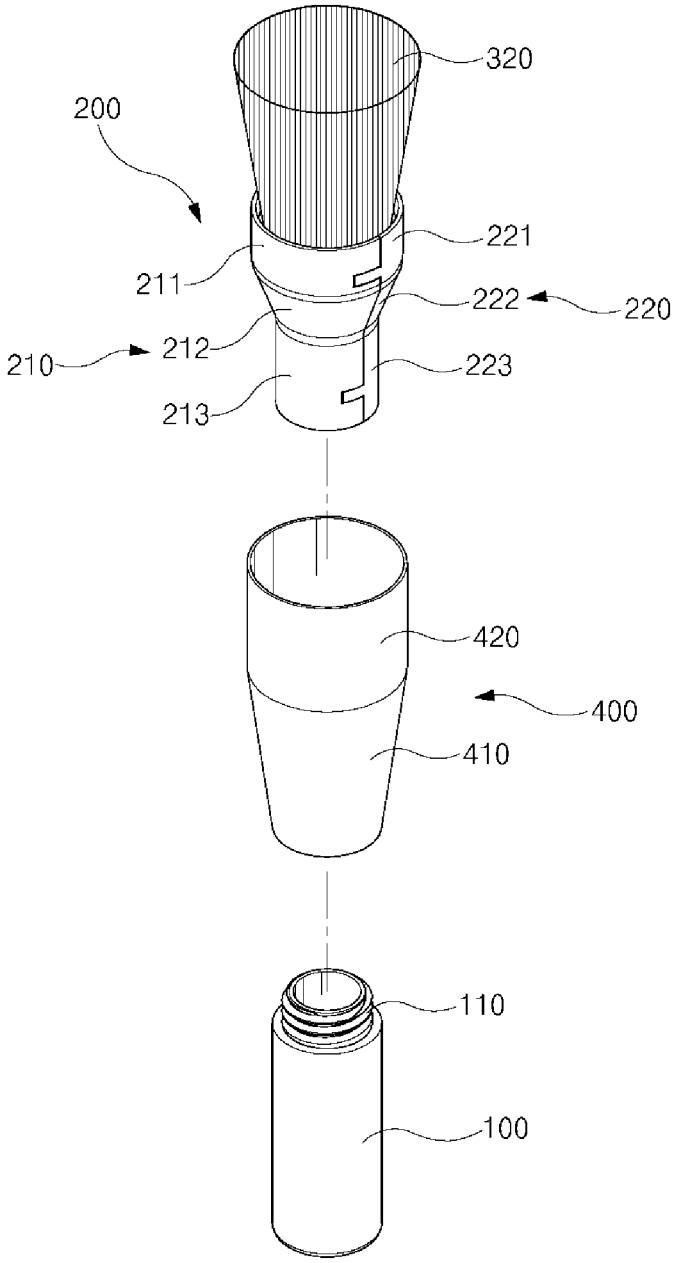
FIG. 2 is an exploded perspective view of FIG. 1.
Figure 3:
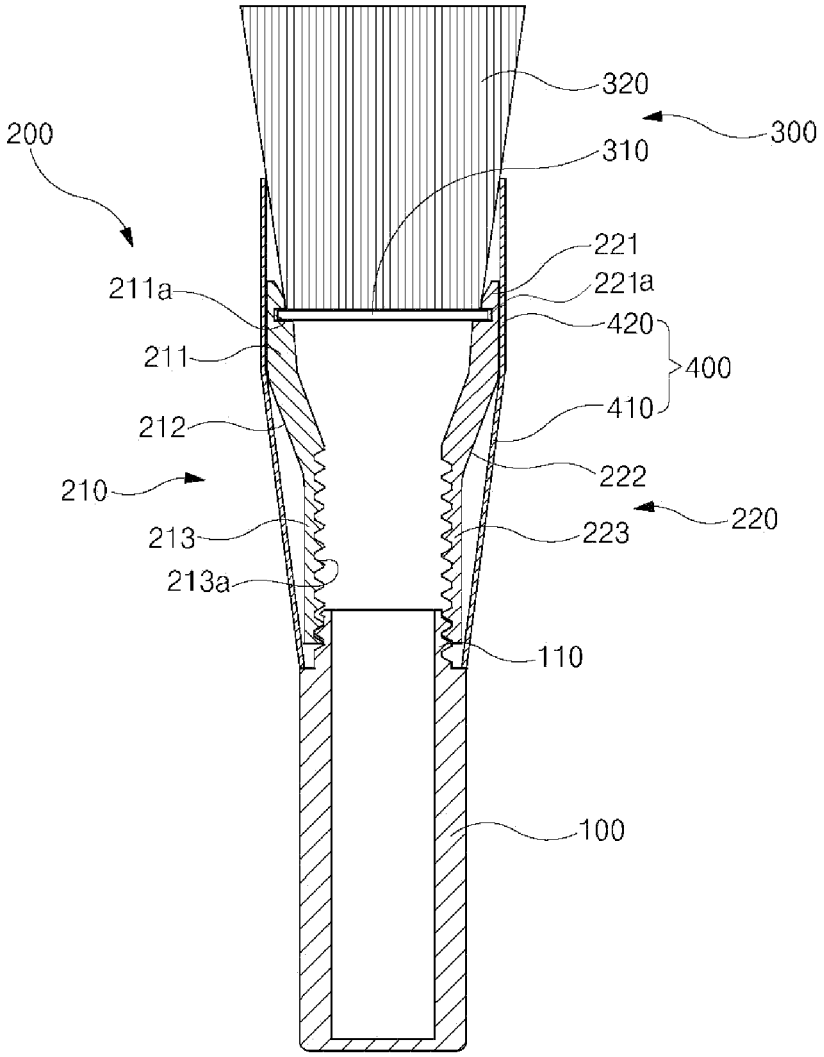
FIG. 3 is a cross-sectional view of FIG. 1.
Figure 4:
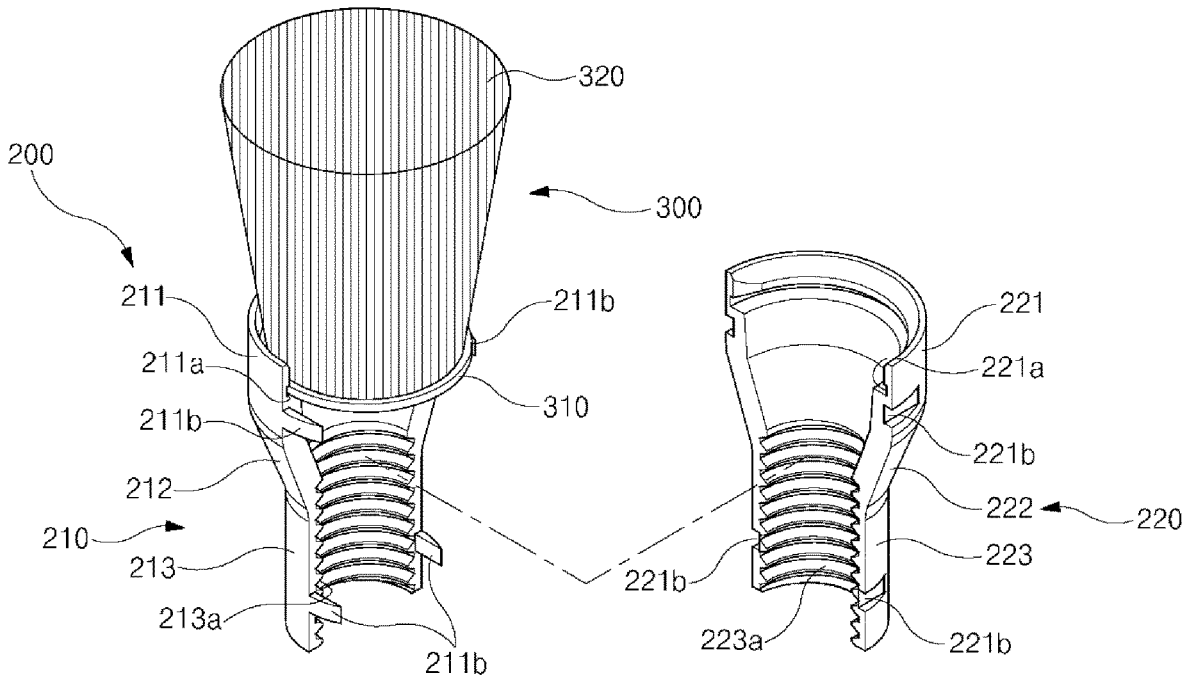
FIG. 4 is a diagram schematically illustrating a first coupling portion and a second coupling portion dissembled from each other in a brush coupling part shown in FIG. 2.

FIG. 1 is a diagram schematically illustrating a cosmetic brush according to an embodiment of the present disclosure, FIG. 2 is an exploded perspective view of FIG. 1, FIG. 3 is a cross-sectional view of FIG. 1, and FIG. 4 is a diagram schematically illustrating a first coupling portion and a second coupling portion dissembled from each other in a brush coupling part shown in FIG. 2.

As illustrated in these drawings, a cosmetic brush 1 according to the embodiment includes a brush body 100 provided with a user's handle, a brush coupling part 200 coupled to the brush body 100, a brush part 300 detachably coupled to the brush coupling part 200, and a connection fixing part 400 having one side coupled to the brush body 100 and the other side supporting a bristle member 320 and provided to surround the brush coupling part 200.

The brush body 100 may have a bar shape, as illustrated in FIG. 2.

In the embodiment, the inside of the brush body 100, as illustrated in FIG. 3, may be empty.

In addition, in the embodiment, on an inner wall of an upper end of the brush body 100, as illustrated in FIG. 3, a body thread 110 is provided so that a first insertion body 212 and a second insertion body 222 of the brush coupling part 200 may be detachably screwed to each other.

The brush coupling part 200 is provided as a coupling space of the brush part 300 and may be detachably coupled to the upper end of the brush body 100, as illustrated in FIG. 2.

In the embodiment, as illustrated in FIG. 3, the brush coupling part 200 includes the first coupling portion 210 and the second coupling portion 220 that are detachably coupled to each other, and may be detachably coupled to the brush body 100 while the first coupling portion 210 and the second coupling portion 220 are coupled to each other.

In addition, a lower portion of the brush part 300 may be detachably inserted and coupled to the inner walls of the first coupling portion 210 and the second coupling portion 220.

The first coupling portion 210 of the brush coupling part 200, as illustrated in FIG. 4, includes a first body 211 surrounding one side of the lower portion of the brush part 300, a first inclined portion 212 provided below the first body 211 to be inclined in a direction of the brush body 100, and a first coupling body 213 provided below the first inclined portion 212 to be screwed to the brush body.

As illustrated in FIG. 4, a first flange coupling groove 211*a* may be provided in the first body 211 of the first coupling portion 210. In the embodiment, the first flange coupling groove 211*a* has a circular shape like a second flange coupling groove 221*a* of the second coupling portion 220 to detachably couple a flange member 310 of the brush part 300. That is, in the embodiment, the flange member 310 may be detachably fitted and coupled to a circular coupling region formed by the first flange coupling groove 211*a* and the second flange coupling groove 221*a*.

In the embodiment, as illustrated in FIG. 4, the first body 211 is provided with a pair of coupling protrusions 211*b*, and the pair of coupling protrusions 211*b* may be inserted and coupled to a protrusion coupling groove 221*b* of the second coupling portion 220.

In the embodiment, the pair of coupling protrusions 211*b* may be provided below the first flange coupling groove 211*a*, as illustrated in FIG. 4.

In the first inclined portion 212 of the first coupling portion 210, as illustrated in FIG. 4, an upper end thereof may be connected to a lower end of the first body 211 and a lower end thereof may be connected to an upper end of the first coupling body 213. In the embodiment, the width of the first inclined portion 212 may be gradually narrowed from the top to the bottom.

On the inner wall of the first coupling body 213 of the first coupling portion 210, as illustrated in FIG. 4, a first thread 213*a* may be provided, wherein the body thread 110 provided in the brush body 100 may be detachably screwed.

In the embodiment, since the first coupling portion 210 and the second coupling portion 220 are detachably coupled to each other, the brush part 300 may be easily separated from the brush coupling part 200 and then replaced.

The second coupling portion 220 of the brush coupling part 200, as illustrated in FIG. 4, includes a second body 221 surrounding one side of the lower portion of the brush part 300 and detachably coupled to the first body 211, a second inclined portion 222 provided below the second body 221 to be inclined in the direction of the brush body 100, and a second coupling body 223 provided below the second inclined portion 222 to be screwed to the brush body and detachably coupled to the first coupling body 213.

As illustrated in FIG. 4, a second flange coupling groove 221*a* may be provided in the second body 221 of the second coupling portion 220. In the embodiment, the second flange coupling groove 221*a* has a circular shape like the first flange coupling groove 211*a* as described above to detachably couple the flange member 310 of the brush part 300.

In the embodiment, as illustrated in FIG. 4, the second body 221 is provided with a pair of protrusion coupling grooves 221*b*, and the pair of protrusion coupling grooves 221*b* may be inserted and coupled with the pair of coupling grooves 211*b* described above.

In the embodiment, the pair of coupling grooves 221*b* may be provided below the second flange coupling groove 221*a*, as illustrated in FIG. 4.

In the second inclined portion 222 of the second coupling portion 220, as illustrated in FIG. 4, an upper end thereof may be connected to a lower end of the second body 221 and a lower end thereof may be connected to an upper end of the second coupling body 223. In the embodiment, the width of the second inclined portion 222 may be gradually narrowed from the top to the bottom.

On the inner wall of the second coupling body 223 of the second coupling portion 220, as illustrated in FIG. 4, a second thread 223*a* may be provided, wherein the body thread 110 provided in the brush body 100 may be detachably screwed.

The brush part 300 may be detachably fitted and coupled to the first flange coupling groove 211*a* and the second flange coupling groove 221*a* provided in the brush coupling part 200, as illustrated in FIG. 4.

In the embodiment, the brush part 300, as illustrated in FIG. 4, includes a flange member 310 and a plurality of bristle members 320 coupled to an upper surface of the flange member 310.

As illustrated in FIG. 3, an edge of the flange member 310 of the brush part 300 may be inserted and coupled into the first flange coupling groove 211*a* and the second flange coupling groove 221*a*. In the embodiment, in the case of replacing the brush part 300, when the first coupling portion 210 and the second coupling portion 220 are separated from each other after the connection fixing part 400 is separated, the flange part may be separated from the first flange coupling groove 211*a* and the second flange coupling groove 221*a* to easily replace the brush part 300.

In the plurality of bristle members 320 of the brush part 300, a lower end thereof may be coupled to an upper surface of the flange body 310 by thermal fusion.

In the embodiment, the plurality of parent members 320 may be also coupled to the flange part using an adhesive harmless to the human body.

The connection fixing part 400, as illustrated in FIG. 3, one side thereof is coupled to the brush body 100 and the other side thereof may be provided to support the bristle member 320 and surround the brush coupling part 200.

In the embodiment, as illustrated in FIG. 3, the connection fixing part 400 includes a first fixing body 410 having a lower end supported by the brush body 100 and a second fixing body 420 provided to extend upward from the first fixing body 410 and having an upper end supported by the bristle member 320.

In the embodiment, the first fixing body 410 may be provided to be inclined in the direction of the brush body 100 from a lower end of the second fixing body 420.

In addition, in the embodiment, the first fixing body 410 may be provided such that the diameter of the upper end thereof is the largest and the diameter gradually decreases toward the lower end thereof.

Furthermore, in the embodiment, the lower end of the first fixing body 410 may be locked and supported to the upper region of the brush body 100.

As described above, in the embodiment, since the brush coupling part is detachably coupled to the brush part while the first coupling portion and the second coupling portion are coupled to each other, and the brush bristle part is detachably coupled and assembled to the brush coupling part without an adhesive, it is possible to fundamentally block harmful components of the adhesive. In addition, since the connection fixing part is coupled to the brush body and the brush coupling part while covering the brush coupling part, it is possible to increase the stability of the coupling. Furthermore, since the brush bristle part is detachable from the brush coupling part, it is possible to easily replace the brush bristle part. In addition, since the upper end of the connection fixing part may support the outside of the plurality of bristle members, it is possible to prevent the spread of the plurality of bristle members and the like.

As described above, the present disclosure is not limited to the embodiments described herein, and it will be apparent to those skilled in the art that various changes and modifications may be made without departing from the spirit and the scope of the present disclosure. Therefore, it will be understood that these changes and modifications are included in the appended claims of the present disclosure.

What is claimed is:

1. A cosmetic brush comprising:

a brush body provided with a user's handle and a body thread;

a brush coupling part coupled to the body thread of the brush body;

a brush bristle part detachably coupled to the brush coupling part and provided with a bristle member; and a connection fixing part having one side coupled to the brush body and the other side supporting the bristle member and provided to surround the brush coupling part, wherein the brush coupling part includes a first coupling portion and a second coupling portion detachably coupled to each other, the brush coupling part is detachably coupled to the brush body while the first coupling portion and the second coupling portion are coupled to each other, and the brush bristle part is detachably coupled to the brush coupling part, wherein the connection fixing part comprises:

a first fixing body having a lower end supported by the brush body; and a second fixing body provided to extend from the first fixing body and having an upper end supporting the bristle member, wherein the first fixing body is provided to be inclined from a lower end of the second fixing body in a direction of the brush body, wherein the first coupling portion comprises:

a first body surrounding a first side of the lower portion of the brush bristle part;

a first inclined portion provided below the first body to be inclined in the direction of the brush body; and a first coupling body provided below the first inclined portion to be screwed to the brush body, wherein a first flange coupling groove is provided on an inner wall of the first body to be detachably coupled with a first side of a flange member of the brush bristle part, wherein the second coupling portion comprises:

a second body surrounding a second side of the lower portion of the brush bristle part and detachably coupled to the first body;

a second inclined portion provided below the second body to be inclined in the direction of the brush body; and a second coupling body provided below the second inclined portion to be screwed to the brush body and detachably coupled to the first coupling body, wherein a second flange coupling groove is provided on an inner wall of the second body to be detachably coupled with a second side of the flange member of the brush bristle part, wherein the first body is provided with a pair of coupling protrusions, the second body is provided with a pair of protrusion coupling grooves, and the pair of coupling protrusions is detachably coupled to the pair of protrusion coupling grooves, wherein the first body and the second body are coupled together to form a cylindrical shape, wherein the first inclined portion and the second inclined portion are coupled together to taper towards the brush body, wherein the first coupling body and the second coupling body are coupled together to form a cylindrical shape having a diameter smaller than a diameter of the first body and the second body which are coupled together;

wherein the second fixing body is cylindrical, wherein the first fixing body tapers toward the brush body, wherein the connection fixing part is dimensioned to allow insertion and removal of the brush coupling part, such that the connection fixing part in inserted upwardly from a lower portion of the brush body towards the brush bristle part until further upward movement is restricted when the first body and the second body are received in the second fixing body by a snug fit, upward movement of the first fixing body is prevented by the first body and the second body, and the lower end of the first fixing body is locked within a lower region of the body thread below the first coupling body and the second coupling body.

* * * * *